US008739496B2

(12) United States Patent
Brodowski

(10) Patent No.: US 8,739,496 B2
(45) Date of Patent: Jun. 3, 2014

(54) STRUCTURE AND CONSTRUCTION METHOD USING A TRANSPARENT OR TRANSLUCENT MEMBER

(71) Applicant: David Brodowski, Wake Forest, NC (US)

(72) Inventor: David Brodowski, Wake Forest, NC (US)

( * ) Notice: Subject to any disclaimer, the term of this patent is extended or adjusted under 35 U.S.C. 154(b) by 0 days.

(21) Appl. No.: 13/785,444

(22) Filed: Mar. 5, 2013

(65) Prior Publication Data

US 2014/0115990 A1 May 1, 2014

Related U.S. Application Data

(60) Provisional application No. 61/795,787, filed on Oct. 26, 2012.

(51) Int. Cl.

| | |
|---|---|
| ***E04B 1/00*** | (2006.01) |
| ***E04G 21/00*** | (2006.01) |
| ***E04G 23/00*** | (2006.01) |

(52) U.S. Cl.

USPC ..... 52/742.14; 52/309.7; 52/309.9; 52/405.1; 52/481.1; 52/800.14; 52/794.1; 52/741.15

(58) Field of Classification Search

USPC ..... 52/306, 308, 309.7, 309.9, 404.1, 52/405.1, 481.1, 798.1, 800.14, 252, 253, 52/259, 294, 741.15, 223.7, 794.1, 52/742.14; 249/35, 48, 49, 50, 22, 13, 249/190; 14/73

See application file for complete search history.

(56) References Cited

U.S. PATENT DOCUMENTS

| | | | | |
|---|---|---|---|---|
| 4,210,304 | A | 7/1980 | Mannina | |
| 4,697,399 | A | 10/1987 | Ryan | |
| 5,065,560 | A | 11/1991 | Yoder | |
| 5,431,366 | A | 7/1995 | Matsumoto et al. | |
| 6,079,168 | A * | 6/2000 | Shaver | 52/202 |
| 6,170,105 | B1 | 1/2001 | Doyle et al. | |
| 6,240,692 | B1 | 6/2001 | Yost et al. | |
| 7,127,856 | B2 * | 10/2006 | Hagen et al. | 52/309.9 |
| 7,168,216 | B2 * | 1/2007 | Hagen, Jr. | 52/480 |
| 7,574,837 | B2 * | 8/2009 | Hagen et al. | 52/404.1 |
| 2002/0011549 | A1 | 1/2002 | Tkalec | |
| 2005/0138891 | A1 | 6/2005 | Wool et al. | |
| 2006/0180733 | A1 | 8/2006 | van de Camp | |

* cited by examiner

*Primary Examiner* — Chi Q Nguyen

(74) *Attorney, Agent, or Firm* — Rabin & Berdo, P.C.

(57) ABSTRACT

A construction method is disclosed. The method includes providing a bottom support between a plurality of structural members and using the bottom support to support a structural material in a plastic state. The method also includes using the bottom support to support the structural material as it hardens from a plastic state into a hardened state. The structural material remains attached to the bottom support after the structural material hardens. The bottom support is transparent or translucent.

14 Claims, 11 Drawing Sheets

STRUCTURE AND CONSTRUCTION METHOD USING A TRANSPARENT OR TRANSLUCENT MEMBER

This application claims the benefit of U.S. Provisional Patent Application Ser. No. 61/795,787, filed Oct. 26, 2012, which is hereby incorporated by reference in its entirety.

TECHNICAL FIELD

The present disclosure is directed to a structure and construction method and, more particularly, to a structure and method using a transparent or translucent member.

BACKGROUND

Stay-in-place (SIP) forms are typically used to make construction simpler and more efficient. Conventional SIP forms include corrugated metal sheets that span transversely between longitudinal beams and supports material such as concrete while the concrete cures. As an alternative to SIP forms, wooden formwork and scaffolding is placed below a location where a concrete member is to be placed, and then removed after the concrete member cures.

One disadvantage of conventional SIP forms is the inability to inspect for corrosion or deficiencies in concrete material poured on the SIP forms during construction and hardened concrete members cured on the SIP forms over the life of the structure. One disadvantage of formwork is the extensive time and labor involved during construction utilizing formwork.

U.S. Pat. No. 4,210,304 (the '304 patent), issued to Mannina, describes a form including a sheet of clear plastic material that is supported by a ladder-like aluminum structure. During construction, poured concrete may be visible through the plastic material and inspected to find and correct surface blemishes.

Although the form disclosed in the '304 patent may provide a method for inspecting concrete during pouring, it does not provide a method for inspecting concrete over a life of a structure. Also, the form system of the '304 patent includes numerous components that form a relatively complex formwork, and thus may require significant labor during construction.

The present disclosure is directed to overcoming one or more of the shortcomings set forth above.

SUMMARY OF THE DISCLOSURE

In accordance with one aspect, the present disclosure is directed toward a construction method. The method includes providing a bottom support between a plurality of structural members and using the bottom support to support a structural material in a plastic state. The method also includes using the bottom support to support the structural material as it hardens from a plastic state into a hardened state. The structural material remains in contact with the bottom support after the structural material hardens. The bottom support is transparent or translucent.

According to another aspect, the present disclosure is directed toward a structural assembly. The structural assembly includes a layer of concrete and a sheet-like member disposed below the layer of concrete and in contact with the layer of concrete. The sheet-like member is a stay-in-place form. The sheet-like member is transparent or translucent.

DETAILED DESCRIPTION

Figure 1:
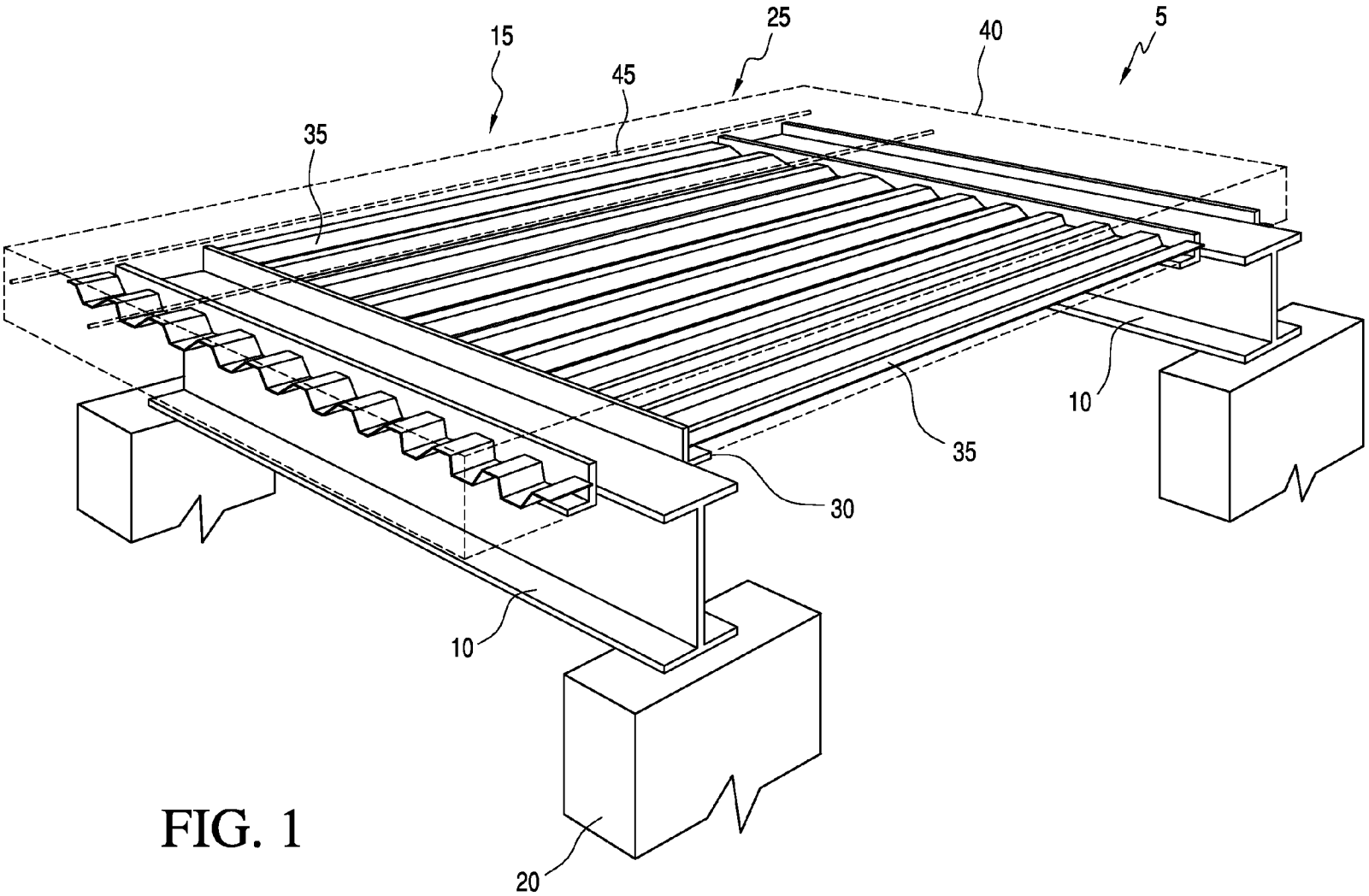
FIG. 1 is a perspective view of an exemplary disclosed structure for supporting a load.

FIG. 1 illustrates an exemplary structure 5 for supporting a loading. Structure 5 may be any suitable structure for supporting load such as, for example, a bridge superstructure assembly, a building floor or roof structural assembly, substructure elements, or a coastal civil engineering structure. Structure 5 may include one or more structural members 10 and a structural assembly 15. Structural members 10 may structurally support structural assembly 15, and a loading may be transmitted to additional structural elements 20 via structural assembly 15 and structural members 10. Structural elements 20 may be any suitable structural elements for transferring load such as, for example, bridge superstructure structural elements, building structural elements, or substructure structural elements such as bearings and columns.

Structural members 10 may be any suitable elements for transferring load such as, for example, beams, walls, portions of superstructure assemblies, or portions of substructure assemblies. For example, structural members 10 may be steel beams or plate girders, reinforced concrete beams, pre-stressed or post-tensioned concrete beams, wooden beams, or composite beams of hybrid construction including concrete, steel, and/or polymer elements. Structural members 10 may be of any suitable shape for transferring load such as, for example, substantially straight structural members, curved members, or bent or angled structural members. One or more structural members 10 may transfer load from structural assembly 15 to additional structural elements 20. It is also contemplated that structural members 10 may transfer load from structural assembly 15 directly to the ground.

As depicted in FIG. 1, structural assembly 15 may include a structural layer 25 (not fully shown in FIG. 1 for overall clarity in depicting structure 5), one or more intermediate structural members 30, and a member 35. Member 35 may support structural layer 25, and intermediate structural members 30 may be attached to member 35 and structural members 10.

Structural layer 25 may be any suitable layer for transferring load, and may include a first structural material 40 and reinforcing members 45. Structural material 40 may be any suitable structural material that may change from a plastic state to a hardened state. For example, structural material 40 may be plastic concrete, which is uncured concrete, that is poured in place on member 35 and that encases reinforcing members 45 that may be reinforcing bars. Thus, for example, when structural material 40 is concrete, structural layer 25 may be a reinforced concrete layer including structural material 40 that is cured concrete that encases reinforcing members 45. Structural material 40 may be any other suitable material that may be poured in a workable plastic state onto member 35 such as, for example, mixtures including aggregate, water, cement, polymers, plastics, and/or low density composite material. Reinforcing members 45 may be any suitable members for reinforcing structural material 40 such as, for example, metal reinforcing members such as steel bars or mesh, and/or composite reinforcement such as polymer or plastic reinforcing members or mesh. It is also contemplated that structural layer 25 may be a material that does not require curing and that is place on member 35 in a hardened state.

Intermediate structural member 30 may be any suitable member for attaching member 35 to a given structural member 10. One or more intermediate structural members 30 may be attached by any suitable method such as, for example, welding, epoxying, or by fasteners such as bolts to structural member 10. For example, intermediate structural member 30 may be a structural member such as an angle having a portion that is welded, epoxied, or bolted to an upper flange of structural member 10. One or more intermediate structural members 30 may also be attached by any suitable method such as, for example, welding, epoxying, or by fasteners such as bolts to member 35. For example, a first portion of a given intermediate structural member 30 may be attached to structural member 10 and a second portion of a given intermediate structural member 30 may be attached to member 35. Intermediate structural member 30 may thereby be an attachment member that attaches structural member 10 to member 35. Several intermediate structural members 30 may be used to attach a partial or full length of structural member 10 to one or more members 35 for supporting structural layer 25, one or more members 35 being disposed along a length of structural member 10, as depicted in FIG. 1. It is also contemplated, as discussed further below with respect to some exemplary embodiments of structure 5, that one or more members 35 be attached to one or more structural members 10 without an intermediate structural member 30.

Member 35 may be any suitable member for supporting structural layer 25 such as, for example, a sheet-like member. For example, member 35 may be a transparent or translucent member such as, for example, transparent plastic. For example, member 35 may include one or more of a glass polymer composite, a polycarbonate, a fiber reinforced polymer, fiberglass, poly(methyl methacrylate), and acrylic material. For example, member 35 may include Plexiglas®, Lucite®, or Perspex®. Also, for example, member 35 may be substantially entirely formed from acrylic materials or substantially entirely formed from polycarbonate materials. Member 35 may be, for example, a form member that is a substantially flat member, a corrugated member, or a ribbed member. For example, member 35 may be any suitable type of stay-in-place form. For example, member 35 may be a stay-in-place form that is transparent or translucent. A plurality of members 35 may be stacked and used to support structural layer 25. Because member 35 may be transparent or translucent, structural layer 25 may be viewed through member 35. Member 35 may thereby be, for example, a bottom support that is transparent or translucent. Member 35 may also thereby be, for example, a sheet-like member disposed below structural layer 25, which may be a layer of concrete, and member 35 may be disposed in contact with the layer of concrete. Member 35 may be formed, for example, from a transparent material that may be a see-through material, or a material having a property of being able to transmit rays of light through it so that elements disposed beyond the material can be clearly and distinctly seen. Also, member 35 may be formed, for example, from a translucent material that may permit light to pass through it, but the material diffuses the light so that elements disposed beyond the material are only partially visible (e.g., can be seen, but may not be clearly and distinctly seen through the material).

Also, for example, member 35 may be formed from polycarbonates meeting ASTM (American Society for Testing and Materials) standards. For example, member 35 may have a tensile strength of between about 5,000 psi (pounds per square inch) and about 15,000 psi, between about 7,000 psi and about 12,000 psi, or between about 8,000 psi and about 10,000 psi. For example, member 35 may be a polycarbonate having a tensile strength of about 9,000 psi. Also, for example, member 35 may have a flexural strength of between about 8,000 psi and about 20,000 psi, between about 10,000 psi and about 18,000 psi, or between about 12,000 psi and about 16,000 psi. For example, member 35 may be a polycarbonate having a flexural strength of about 14,000 psi. For example, in one exemplary embodiment, member 35 may be a polycarbonate having a tensile strength of about 9,000 psi, a tensile modulus of about $3.1\times10^5$ psi, a flexural strength of about 14,000 psi, and a flexural modulus of about $3.4\times10^5$ psi. One exemplary material from which member 35 may be formed is Lexan®, manufactured by SABIC Innovative Plastics.

Also, for example, member 35 may be formed from acrylic sheets (e.g., Poly(methyl methacrylate) with properties meeting ASTM methods and standards. For example, member 35 may be formed from acrylic sheets having a tensile strength of between about 5,000 psi and about 15,000 psi (e.g., about 10,000 psi), a rupture modulus of elasticity of between about 350,000 psi and 450,000 psi (e.g., 400,000 psi), a flexural strength of between about 10,000 psi and about 25,000 psi (e.g., 17,000 psi), and a modulus of elasticity of between about 425,000 psi and about 550,000 psi (e.g., about 480,000 psi). One exemplary material from which member 35 may be formed is Acrylite®.

Member 35 may have, for example, a thickness of between about 0.01" and about 1.0", or of between about 0.05" and about 0.5". A thickness of member 35 may depend on span length, loading, and profile (e.g., corrugated, flat sheet, or twin wall). It is contemplated that a profile and a material thickness of member 35 may be optimized based on specific construction project conditions.

Figure 2:
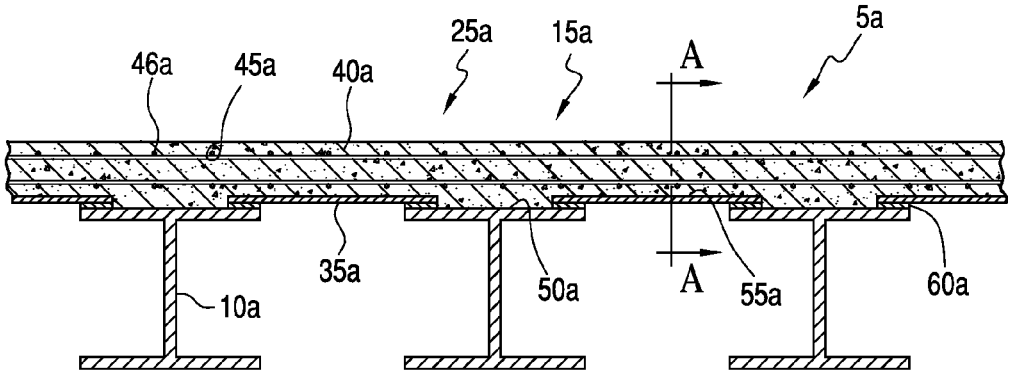
FIG. 2 is a sectional view of a first exemplary embodiment of the exemplary structure.
Figure 3:
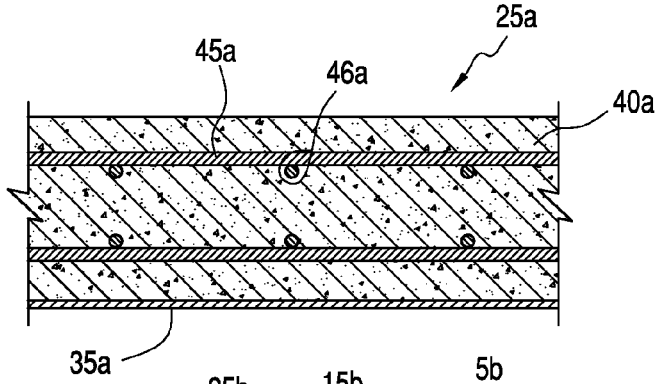
FIG. 3 is a sectional view taken through section A-A of the first exemplary embodiment shown in FIG. 2.

FIGS. 2 and 3 illustrate a first additional exemplary embodiment of the disclosed structure. Structure 5*a* may include a structural assembly 15*a* that is supported by a plurality of structural members 10*a*. Each structural member 10*a* may be any suitable structural member such as, for example, a steel structural shape, a built-up steel member, or a plate girder.

Structural assembly 15*a* may include a structural layer 25*a* that is supported on a member 35*a*. Structural layer 25*a* may include a structural material 40*a* that may be concrete and reinforcing members 45*a* and 46*a* that may be steel reinforcing bars disposed within structural layer 25*a*. For example, a plurality of reinforcing members 45*a* and 46*a* may form a rebar cage. Structural material 40*a* may be concrete that is poured on upper surfaces 50*a* of structural members 10*a* and upper surfaces 55*a* of members 35*a*. Structural material 40*a* may encase reinforcing members 45*a* and 46*a* and be cured. Thus, after curing, structural layer 25*a* may be a reinforced concrete layer supported on upper surfaces 50*a* of structural members 10*a* and upper surfaces 55*a* of members 35*a*.

Member 35*a* may be a transparent or translucent member that may be similar to member 35, disclosed above. As illustrated in FIGS. 2 and 3, member 35*a* may be a sheet-like member that is substantially flat and that is disposed below structural layer 25*a* and in contact with structural layer 25*a*. Member 35*a* may be supported on upper surfaces 50*a* of structural members 10*a* via a plurality of haunches 60*a*. Haunches 60*a* may be any suitable haunch for supporting members 35*a* such as, for example, steel plates. Haunches 60*a* may be attached to structural members 10*a* by any suitable method such as, for example, welding. Members 35*a* may be attached to haunches 60*a* by any suitable method such as, for example, epoxying. It is contemplated that member 35*a* may set directly on upper surfaces 50*a*, without haunches 60*a* being provided. It is also contemplated that a plurality of members 35*a* may be stacked to support structural layer 25*a* when structural material 40*a* is in a plastic state.

Figure 4:
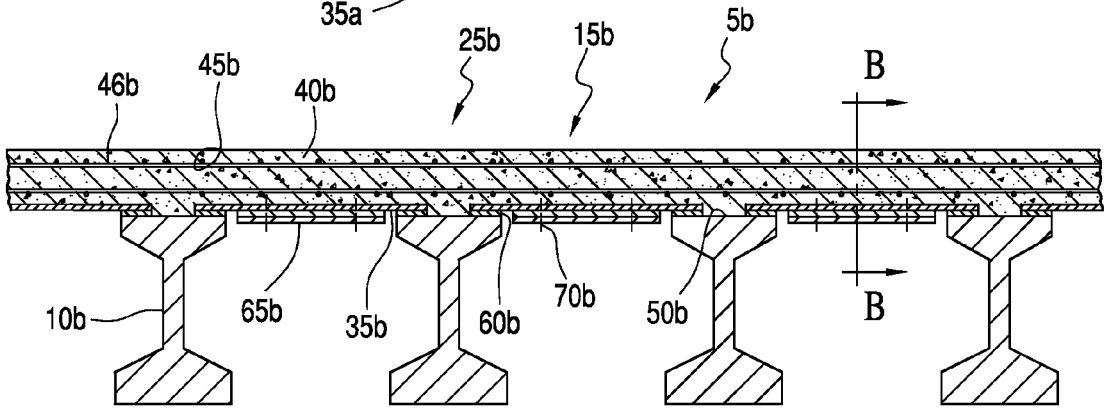
FIG. 4 is a sectional view of a second exemplary embodiment of the exemplary structure.
Figure 5:
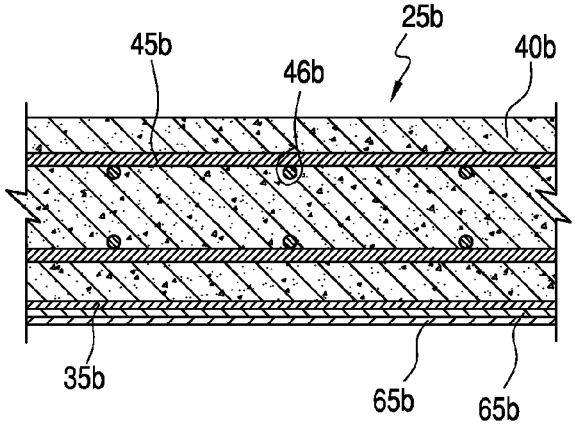
FIG. 5 is a sectional view taken through section B-B of the second exemplary embodiment shown in FIG. 4.

FIGS. 4 and 5 illustrate a second exemplary embodiment of the disclosed structure. Structure 5*b* may include a structural assembly 15*b* that is supported by a plurality of structural members 10*b*. Each structural member 10*b* may be any suitable structural member such as, for example, a reinforced concrete beam, a prestressed concrete beam, or a post-tensioned concrete beam. Also, each structural member 10*b* (as well as the structural members disclosed in any of the other exemplary embodiments herein) may be any other suitable structural member such as, for example, a hybrid composite beam that includes steel, concrete, and/or composite materials, or a structural member formed substantially entirely from composite materials.

Structural assembly 15*b* may include a structural layer 25*b* that is supported on a member 35*b*. Structural layer 25*b* may include a structural material 40*b* and reinforcing members 45*b* and 46*b* that may be similar to structural material 40*a* and reinforcing members 45*a* and 46*a*, respectively, disclosed above.

Member 35*b* may be a transparent or translucent member that may be similar to members 35 and 35*a*, disclosed above. As illustrated in FIGS. 4 and 5, member 35*b* may be a sheet-like member that is substantially flat and that is disposed below structural layer 25*b* and in contact with structural layer 25*b*. Member 35*b* may be supported on upper surfaces 50*b* of structural members 10*b* via a plurality of haunches 60*b*. Each haunch 60*b* may be any suitable haunch for supporting members 35*b* such as, for example, a concrete haunch, and may be integral with a given structural member 10*b*. Members 35*b* may be attached to haunches 60*b* by any suitable method such as, for example, epoxying.

Additional members 65*b* may be stacked on member 35*b* whenever appropriate. In one exemplary case, when center-to-center span lengths between adjacent structural members 10*b* exceed 3 feet (e.g., between about 3 feet and about 5 feet), additional members 65*b* may be stacked on member 35*b*. If center-to-center spans exceed about 5 feet, then stackable corrugated members may be used or additional supporting members may be used (discussed further in the embodiments below). A vertical deflection due to loading between structural members 10*b* may thereby be limited to, for example, about ½" to about ¾". Any suitable number of additional members 65*b* may be stacked such as, for example, two, three, four, or more additional members 65*b*. Additional members 65*b* may be attached and stacked by any suitable method such as, for example, epoxying or fasteners. For example, additional members 65*b* may be attached via fastener assemblies 70*b*, as illustrated in FIG. 4. Fastener assemblies 70*b* may be any suitable fastener assemblies for permanently or removably attaching additional members 65*b* to member 35*b*. For example, fastener assemblies 70*b* may be threaded rod assemblies that may be inserted through aligned apertures that are made in member 35*b* and additional members 65*b* prior to a placement of structural material 40*b* of structural layer 25*b*. It is also contemplated that fastener assemblies 70*b* may be fastened to reinforcing members 45*b* and 46*b*. Additional members 65*b* may be removed by removing some or all of fastener assemblies 70*b* after structural material 40*b* of structural layer 25*b* has cured, and may be re-used at other locations having members 35*b*. An additional member 65*b* may thereby be a removable form that is transparent or translucent. A plurality of additional members 65*b* may thereby be added as additional removable forms that are stacked beneath member 35*b* and a first additional member 65*b*. It is contemplated that members 35*b* and additional members 65*b* may be, for example, stackable corrugated members. Additional members 65*b* may thereby be removable corrugated forms that are nested with member 35*b*.

Figure 6:
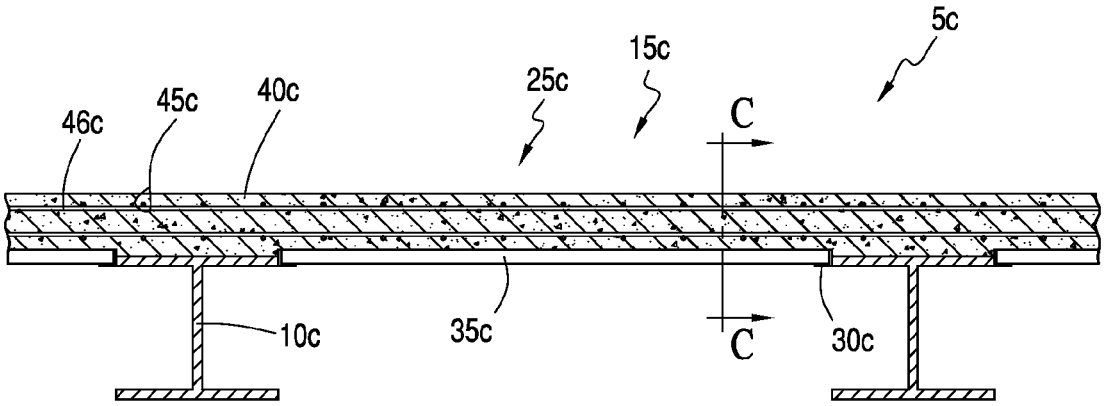
FIG. 6 is a sectional view of a third exemplary embodiment of the exemplary structure.
Figure 7:
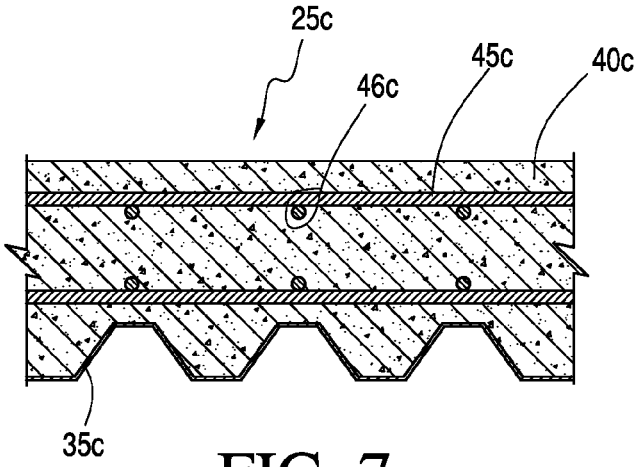
FIG. 7 is a sectional view taken through section C-C of the third exemplary embodiment shown in FIG. 6.

FIGS. 6 and 7 illustrate a third exemplary embodiment of the disclosed structure. Structure 5*c* may include a structural assembly 15*c* that is supported by a plurality of structural members 10*c*. Each structural member 10*c* may be any suitable structural member such as, for example, a steel structural shape, a built-up steel member, or a plate girder.

Structural assembly 15*c* may include a structural layer 25*c* that is supported on a member 35*c*. Structural layer 25*c* may include a structural material 40*c* and reinforcing members 45*c* and 46*c* that may be similar to structural material 40*a* and reinforcing members 45*a* and 46*a*, respectively, disclosed above.

Member 35*c* may be a transparent or translucent member that may be similar to member 35, disclosed above. As illustrated in FIGS. 6 and 7, member 35*c* may be a sheet-like member that is a corrugated member and that is disposed below structural layer 25*c* and in contact with structural layer 25*c*. It is contemplated that a plurality of additional members may be stacked on member 35*c*, similar to member 35*b* and additional members 65*b* of structural assembly 15*b*. It is also contemplated that member 35*c* may be stiffened with ribs that are disposed between the corrugation.

Structural assembly 15*c* may further include one or more intermediate structural members 30*c* that may be similar to intermediate structural members 30, disclosed above. Intermediate structural member 30*c* may be any suitable member for attaching a given member 35*c* to a given structural member 10*c*. For example, intermediate structural member 30*c* may be a structural member such as an angle having a portion that is welded to an upper flange of structural member 10*c*. As illustrated in FIG. 6, another portion of intermediate structural member 30*c* may be attached to member 35*c* by any suitable method such as, for example, epoxying or by fasteners such as bolts. For example, a first portion of a given intermediate structural member 30*c* may be attached to structural member 10*c* and a second portion of the given intermediate structural member 30*c* may be attached to member 35*c*. Intermediate structural member 30*c* may thereby be an attachment member that attaches structural member 10*c* to member 35*c*. For example, as illustrated in FIG. 6, a horizontal portion of intermediate structural member 30*c* may support a portion of member 35*c*, and a vertical portion of intermediate structural member 30*c* may be attached to a flange of structural member 10*c*. Several intermediate structural members 30*c* may be used to attach a partial or full length of structural member 10*c* to one or more members 35*c*. Intermediate structural member 30*c* may thereby be a seat on which member 35*c* is supported.

Figure 8:
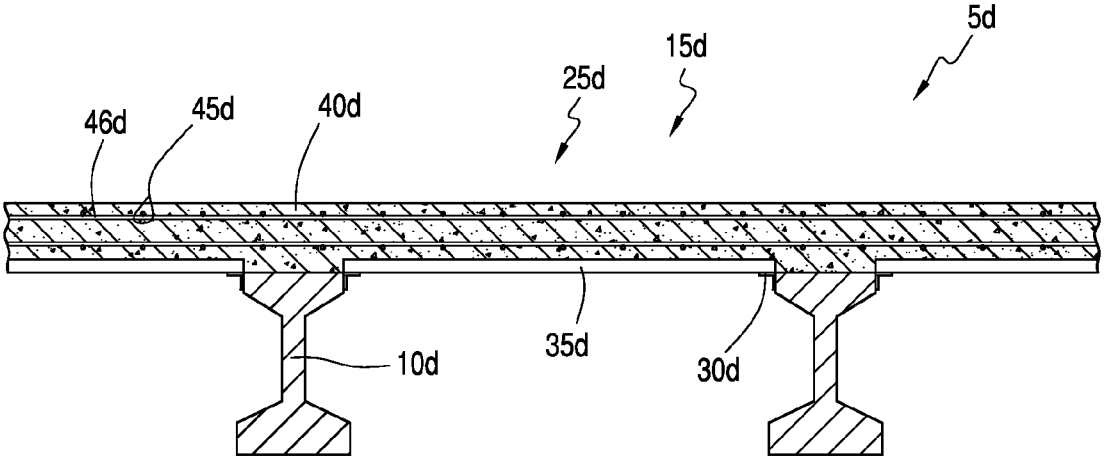
FIG. 8 is a sectional view of a fourth exemplary embodiment of the exemplary structure.

FIG. 8 illustrates a fourth exemplary embodiment of the disclosed structure. Structure 5*d* may include a structural assembly 15*d* that is supported by a plurality of structural members 10*d*. Each structural member 10*d* may be any suitable structural member such as, for example, a reinforced concrete beam, a prestressed concrete beam, or a post-tensioned concrete beam.

Structural assembly 15*d* may include a structural layer 25*d* that is supported on a member 35*d*. Structural layer 25*d* may include a structural material 40*d* and reinforcing members 45*d* and 46*d* that may be similar to structural material 40*a* and reinforcing members 45*a* and 46*a*, respectively, disclosed above. Member 35*d* may be a transparent or translucent member that may be similar to member 35*c*, disclosed above and as illustrated in FIG. 7.

Structural assembly 15*d* may further include one or more intermediate structural members 30*d* that may be similar to intermediate structural members 30*c*, disclosed above. Intermediate structural member 30*d* may be a structural member such as an angle having a portion that is epoxied to an upper flange of structural member 10*d*. As illustrated in FIG. 8, a first portion of a given intermediate structural member 30*d* may be attached to structural member 10*d* and a second portion of the given intermediate structural member 30*d* may be attached to member 35*d*. Intermediate structural member 30*d* may thereby be an attachment member, similar to intermediate structural member 30*c*. It is contemplated that intermediate structural member 30*c* and intermediate structural member 30*d* may each be disposed in varying orientations as illustrated in FIGS. 6 and 8.

Figure 9:
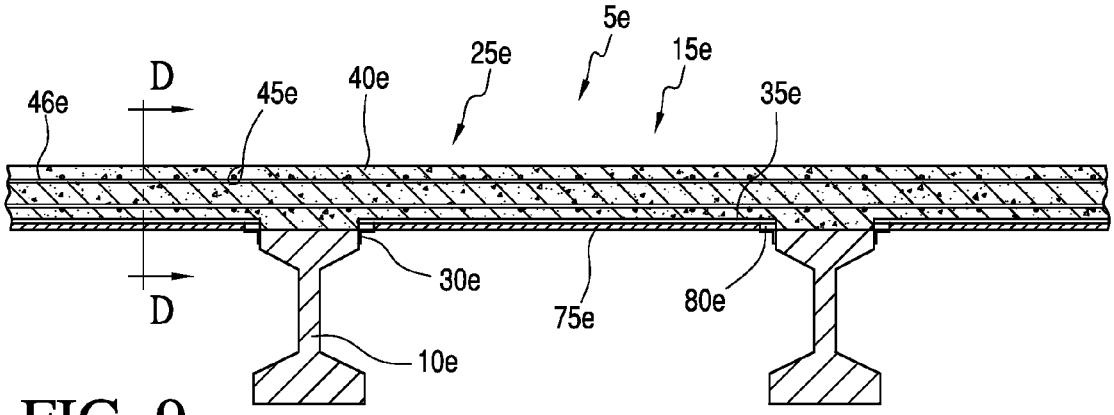
FIG. 9 is a sectional view of a fifth exemplary embodiment of the exemplary structure.
Figure 10:
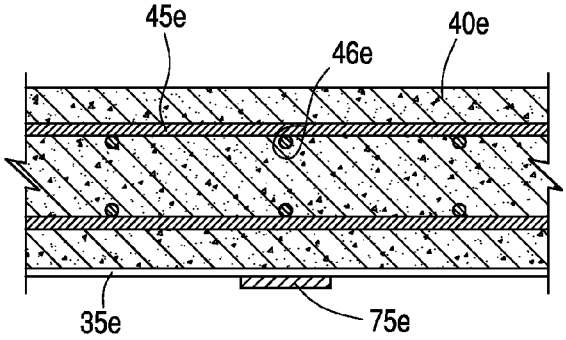
FIG. 10 is a sectional view taken through section D-D of the fifth exemplary embodiment shown in FIG. 9.

FIGS. 9 and 10 illustrate a fifth exemplary embodiment of the disclosed structure. Structure 5*e* may include a structural assembly 15*e* that is supported by a plurality of structural members 10*e*. Each structural member 10*e* may be any suitable structural member such as, for example, a reinforced concrete beam, a prestressed concrete beam, or a post-tensioned concrete beam. It is also contemplated that structural members 10*e* may also be structural members such as, for example, steel structural shapes, a built-up steel members, plate girders, wooden beams, or composite beams of hybrid construction including concrete, steel, and/or polymer elements.

Structural assembly 15*e* may include a structural layer 25*e* that is supported on a member 35*e*. Structural layer 25*e* may include a structural material 40*e* and reinforcing members 45*e* and 46*e* that may be similar to structural material 40*a* and reinforcing members 45*a* and 46*a*, respectively, disclosed above. Member 35*e* may be similar to member 35*a*, disclosed above. Structural assembly 15*e* may also include an intermediate structural member 30*e* that may be similar to intermediate structural member 30*d*, disclosed above.

Structural assembly 15*e* may also include a supporting member 75*e* that may be permanently or removably attached to structural assembly 15*e*. A lower surface of member 35*e* may be in bearing contact with an upper surface of supporting member 75*e*. Supporting member 75*e* may be any suitable member for increasing a stiffness of structural assembly 15*e* such as, for example, a metal plate such as a steel plate. Supporting member 75*e* may also be formed from one or more of a metal such as steel, a polymeric or plastic material, wood, composite material, or any other suitable structural material. Supporting member 75*e* may be attached to member 35*e* by any suitable method such as epoxying. Supporting member 75*e* may also be removably or permanently attached to intermediate structural member 30*e* via a connection 80*e*. Connection 80*e* may be any suitable method for connecting supporting member 75*e* and intermediate structural member 30*e* such as, for example, a threaded connection, a bolted connection, a welded connection, or an epoxied connection. Supporting member 75*e* may also be removed by, for example, saw-cutting. Supporting member 75*e* may thereby increase the stiffness of structural assembly 15*e* when, for example, member 35*e* supports structural material 40*e* in a plastic state. It is also contemplated that member 35*e* may be supported partially or entirely by conventional shoring systems.

Figure 11:
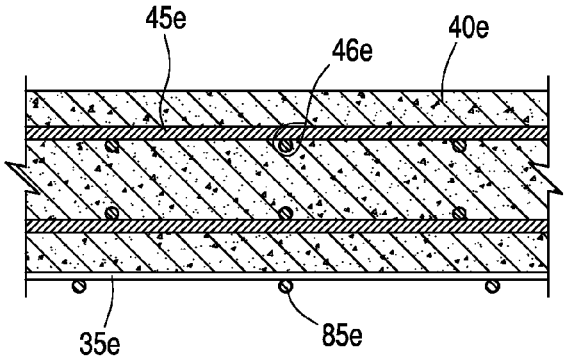
FIG. 11 is a sectional view showing an alternative embodiment of the fifth exemplary embodiment shown in FIG. 9.

FIG. 11 illustrates an alternative embodiment of the fifth exemplary embodiment, in which a supporting member 85*e* is disposed in bearing contact with a lower surface of member 35*e* and thereby increases a stiffness of structural assembly 15*e*. Supporting member 85*e* may be a steel reinforcing bar.

Figure 12:
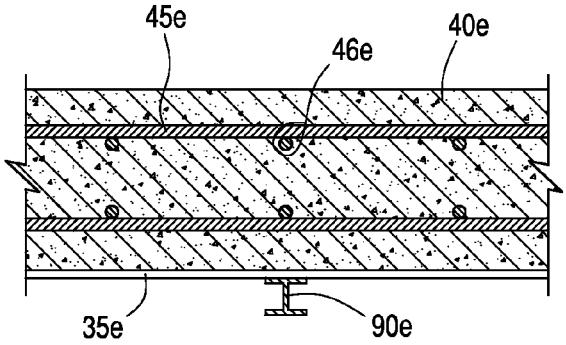
FIG. 12 is a sectional view showing an additional alternative embodiment of the fifth exemplary embodiment shown in FIG. 9.

FIG. 12 illustrates an alternative embodiment of the fifth exemplary embodiment in which a supporting member 90*e* is disposed in bearing contact with a lower surface of member 35*e* and thereby increases a stiffness of structural assembly 15*e*. Supporting member 90*e* may be a structural shape such as, for example, a steel prefabricated structural shape.

Figure 13:
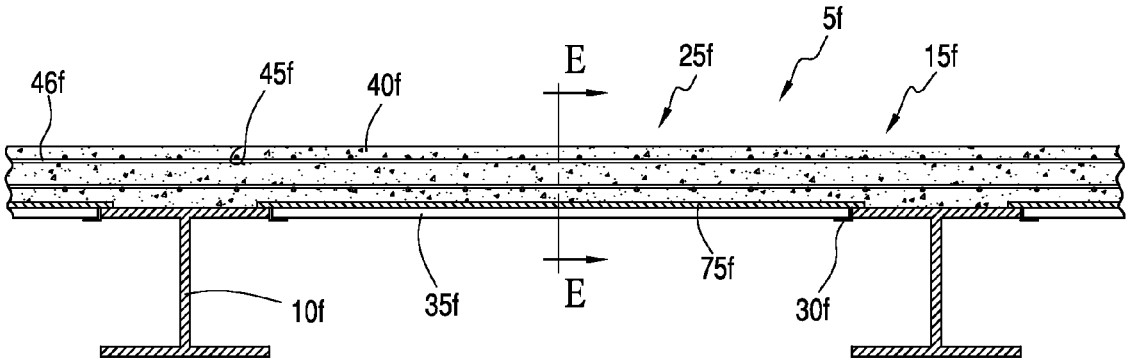
FIG. 13 is a sectional view of a sixth exemplary embodiment of the exemplary structure.
Figure 14:
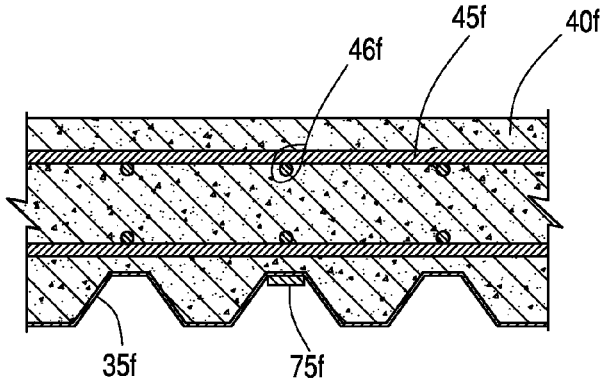
FIG. 14 is a sectional view taken through section E-E of the sixth exemplary embodiment shown in FIG. 13.

FIGS. 13 and 14 illustrate a sixth exemplary embodiment of the disclosed structure. Structure 5*f* may include a structural assembly 15*f* that is supported by a plurality of structural members 10*f*. Each structural member 10*f* may be any suitable structural member such as, for example, a steel structural shape, a built-up steel member, or a plate girder. It is also contemplated that structural members 10*f* may also be structural members such as, for example, reinforced concrete beams, prestressed concrete beams, post-tensioned concrete beams, wooden beams, or composite beams of hybrid construction including concrete, steel, and/or polymer elements.

Structural assembly 15*f* may include a structural layer 25*f* that is supported on a member 35*f*. Structural layer 25*f* may include a structural material 40*f* and reinforcing members 45*f* and 46*f* that may be similar to structural material 40*a* and reinforcing members 45*a* and 46*a*, respectively, disclosed above. Member 35*f* may be similar to member 35*c*, disclosed above. Structural assembly 15*f* may also include an intermediate structural member 30*f* that may be similar to intermediate structural member 30*c*, disclosed above.

Structural assembly 15*f* may also include a supporting member 75*f* that may be permanently or removably attached to structural assembly 15*f*. A lower surface of member 35*f* may be in bearing contact with an upper surface of supporting member 75*f*. Supporting member 75*f* may be similar to supporting member 75*e*, disclosed above, and may be nested between corrugations of member 35*f*, as illustrated in FIG. 14. Supporting member 75*f* may be permanently or removably attached to structural assembly 15*f* in a manner similar to the attachment of supporting member 75*e* to structural assembly 15*e*, disclosed above.

Figure 15:
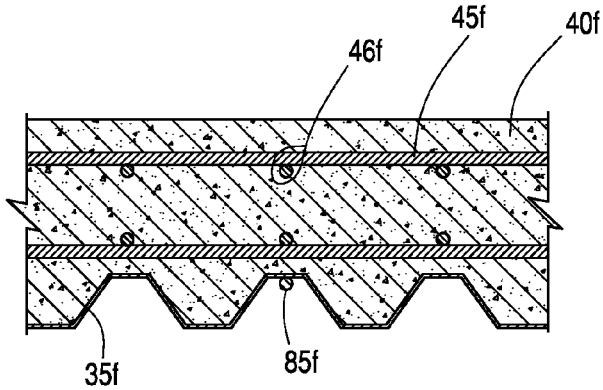
FIG. 15 is a sectional view showing an alternative embodiment of the sixth exemplary embodiment shown in FIG. 13.

FIG. 15 illustrates an alternative embodiment of the sixth exemplary embodiment, in which a supporting member 85*f* is disposed in bearing contact with a lower surface of member 35*f* and thereby increases a stiffness of structural assembly 15*f*. Supporting member 85*f* may be a steel reinforcing bar.

Figure 16:
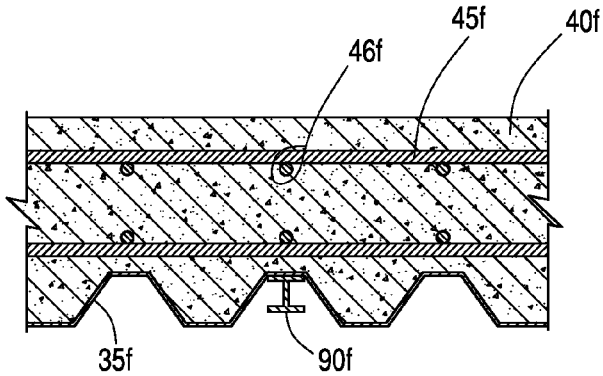
FIG. 16 is a sectional view showing an additional alternative embodiment of the sixth exemplary embodiment shown in FIG. 13.

FIG. 16 illustrates an alternative embodiment of the sixth exemplary embodiment in which a supporting member 90*f* is disposed in bearing contact with a lower surface of member 35*f* and thereby increases a stiffness of structural assembly 15*f*. Supporting member 90*f* may be a structural shape such as, for example, a steel structural shape.

Figure 17:
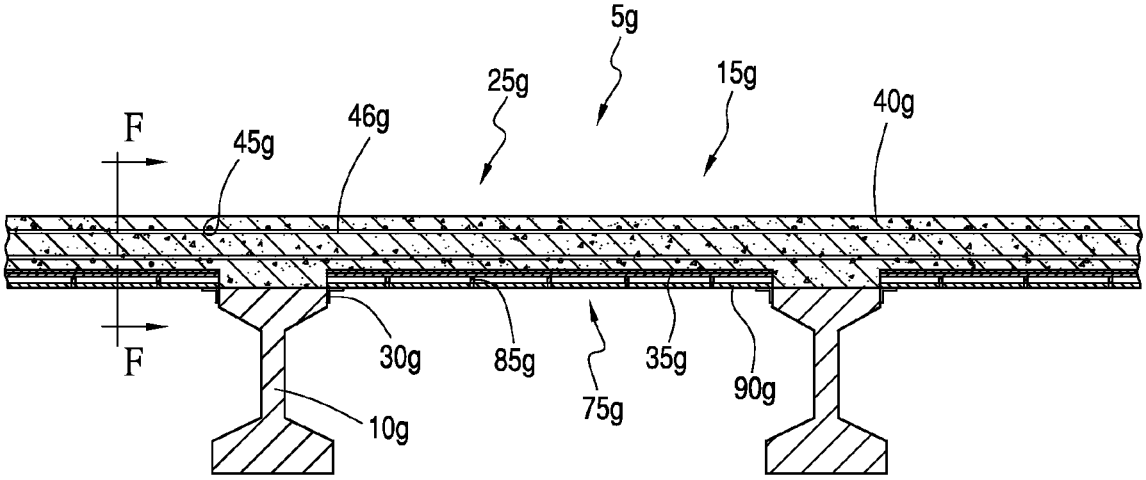
FIG. 17 is a sectional view of a seventh exemplary embodiment of the exemplary structure.
Figure 18:
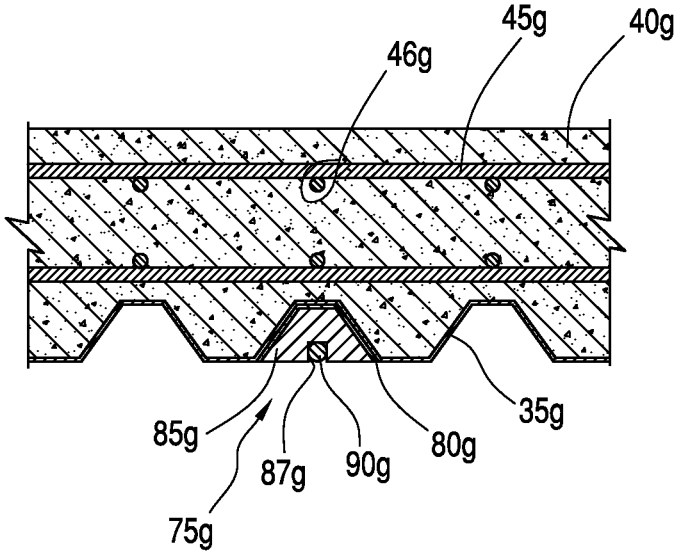
FIG. 18 is a sectional view taken through section F-F of the seventh exemplary embodiment shown in FIG. 17.
Figure 19:
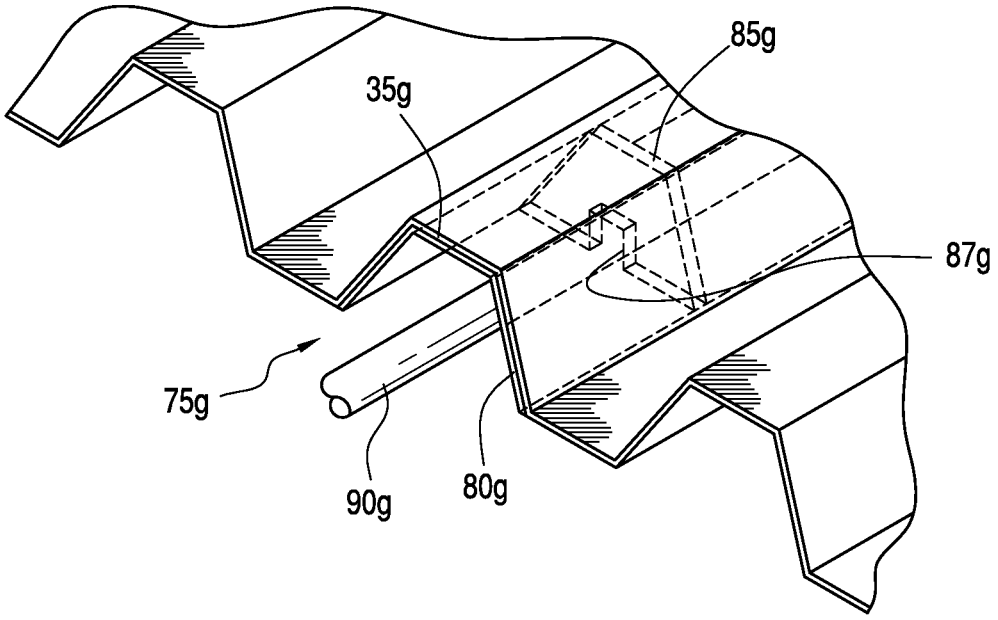
FIG. 19 is a schematic view of the seventh exemplary embodiment of the exemplary structure.

FIGS. 17, 18, and 19 illustrate a seventh exemplary embodiment of the disclosed structure. Structure 5*g* may include a structural assembly 15*g* that is supported by a plurality of structural members 10*g* that may be similar to structural members 10*e*, disclosed above.

Structural assembly 15*g* may include a structural layer 25*g* that is supported on a member 35*g*. Structural layer 25*g* may include a structural material 40*g* and reinforcing members 45*g* and 46*g* that may be similar to structural material 40*a* and reinforcing members 45*a* and 46*a*, respectively, disclosed above. Member 35*g* may be similar to member 35*c*, disclosed above. Structural assembly 15*g* may also include an intermediate structural member 30*g* that may be similar to intermediate structural member 30*d*, disclosed above.

Structural assembly 15*g* may also include a supporting assembly 75*g* that may be permanently or removably attached to structural assembly 15*g*. Supporting assembly 75*g* may include a member 80*g*, one or more members 85*g*, and a supporting member 90*g*. Member 80*g* may be formed in a corrugated shape similar to member 35*g*, and may be nested within member 35*g*. Member 80*g* may be nested in a single cavity formed by member 35*g* (as illustrated in FIGS. 18 and 19), or may have a similar width as member 35*g* and span across a plurality of cavities of member 35*g*. Members 85*g* may have a perimeter shape that is similar to an inner contour of member 80*g*, and may be nested within member 85*g*, as illustrated in FIGS. 18 and 19. A plurality of members 85*g* may be attached by any suitable method such as welding at discrete locations along a length of member 80*g*, as illustrated in FIG. 17. Thus, member 85*g* may be a plate-like member that is attached at discrete locations along member 80*g*. Members 85*g* may help workers to grip components of supporting assembly 75*g* with tools (e.g., wrenches). It is also contemplated that member 85*g* may be attached directly to member 35*g* at discrete locations along a length of member 35*g*. As illustrated in FIGS. 18 and 19, member 85*g* may be disposed vertically relative to a length of members 35*g* and 80*g*. As illustrated in FIGS. 18 and 19, each member 85*g* may include a recess 87*g*. For example, recess 87*g* may be a rectangular, curved, or doghouse opening for allowing supporting member 90*g* to pass through member 85*g*. Supporting member 90*g* may be disposed in recesses 87*g* of members 85*g*, and may be in bearing contact with a surface of each member 85*g* at each recess 87*g*. Supporting member 90*g* may be an elongated structural element disposed in recesses 87*g* such as, for example, a reinforcing bar, a structural shape, or a plate. Each member 80*g*, member 85*g*, and supporting member 90*g* of supporting assembly 75*g* may be formed from one or more any suitable material for increasing a stiffness of structural assembly 15*g* such as, for example, a metal such as steel, a polymeric or plastic material, wood, or any other suitable structural material. Supporting assembly 75*g* may be removably or permanently attached to intermediate structural member 30*g* in a manner similar to the attachment of supporting member 75*e* to intermediate structural member 30*e*, disclosed above. Supporting assembly 75*g* may thereby increase the stiffness of structural assembly 15*g*, for example, when member 35*g* supports structural material 40*g* in a plastic state.

Figure 20:
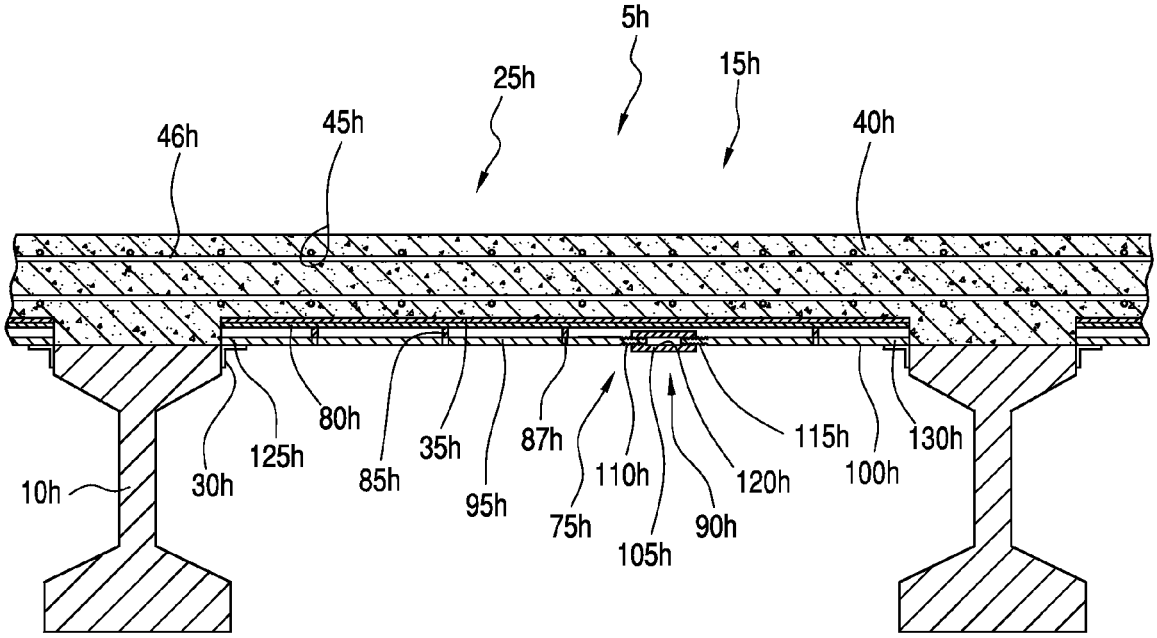
FIG. 20 is a sectional view of an eighth exemplary embodiment of the exemplary structure.

FIG. 20 illustrates an eighth exemplary embodiment of the disclosed structure. Structure 5*h* may include a structural assembly 15*h* that is supported by a plurality of structural members 10*h* that may be similar to structural members 10*e*, disclosed above.

Structural assembly 15*h* may include a structural layer 25*h* that is supported on a member 35*h*. Structural layer 25*h* may include a structural material 40*h* and reinforcing members 45*h* and 46*h* that may be similar to structural material 40*a* and reinforcing members 45*a* and 46*a*, respectively, disclosed above. Member 35*h* may be similar to member 35*c*, disclosed above. Structural assembly 15*h* may also include an intermediate structural member 30*h* that may be similar to intermediate structural member 30*d*, disclosed above.

Structural assembly 15*h* may also include a supporting assembly 75*h* that may be permanently or removably attached to structural assembly 15*h*. Supporting assembly 75*h* may include a member 80*h* and one or more members 85*h*, which may be similar to member 80*g* and one or more members 85*g*, respectively, of supporting assembly 75*g*. Members 85*h* may have recesses 87*h*, similar to recesses 87*g* of members 85*g*, disclosed above.

Supporting assembly 75*h* may also include one or more supporting member assemblies 90*h*. Each supporting member assembly 90*h* may include a supporting member 95*h*, a supporting member 100*h*, and a coupler 105*h*. Supporting members 95*h* and 100*h* may be generally similar to supporting member 90*g*, disclosed above, and may also include respective attachment portions 110*h* and 115*h*. Attachment portions 110*h* and 115*h* may include any suitable configuration for coupling such as, for example, threading. Coupler 105*h* may be any suitable coupler for coupling supporting members 95*h* and 100*h* such as, for example, a coupler formed from a metal such as steel, polymer, or any other suitable structural material. Coupler 105*h* may include an attachment aperture 120*h* including any suitable configuration for coupling such as, for example, threading. Any other suitable coupling method may also be used to couple coupler 105*h* to supporting members 95*h* and 100*h* such as, for example, a mechanical coupling including a removable fastener such as a bolt or cotter pin, a magnetic coupler, a coupler that couples based on electrical charge, a coupler that couples by using an adhesive, or a coupler that couples based on mating surfaces that may be removably attached. When supporting members 95*h* and 100*h* are coupled to coupler 105*h*, respective end portions 125*h* and 130*h* may bear on intermediate structural members 30*h*, to thereby support supporting member assembly 90*h* on intermediate structural members 30*h*. Supporting member 95*h* and/or supporting member 100*h* may be selectively displaced relative to coupler 105*h*. For example, supporting member 95*h* and/or supporting member 100*h* may be rotated so that threaded surfaces of supporting member 95*h* and/or supporting member 100*h* displace relative to threaded surfaces of coupler 105*h*. Also, for example, coupler 105*h* may be selectively released (e.g., a fastener may be removed, mating surfaces may be separated, a magnetic coupling may be de-activated, or a coupling based on electrical charge or adhesive may be de-activated) to allow supporting member 95*h* and/or supporting member 100*h* to be displaced.

FIGS. 21, 22, 23, and 24 illustrate a ninth exemplary embodiment of the disclosed structure. Structure 5*i* may include a structural assembly 15*i* that is supported by a plurality of structural members 10*i* that may be similar to structural members 10*e*, disclosed above. Structural assembly 15*i* may be similar to any of structural assemblies 15*a*, 15*b*, 15*c*, 15*d*, 15*e*, 15*f*, 15*g*, or 15*h* disclosed above, and may include a structural layer 25*i*, an intermediate structural member 30*i*, and a member 35*i*. Member 35*i* may be a corrugated member similar to member 35*c*, disclosed above.

Figure 21:
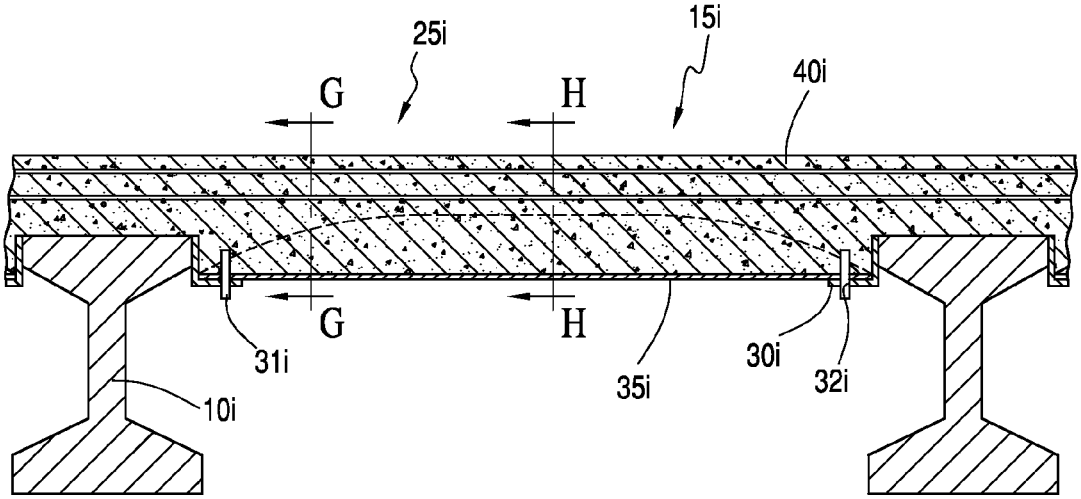
FIG. 21 is a sectional view of a ninth exemplary embodiment of the exemplary structure.
Figure 24:
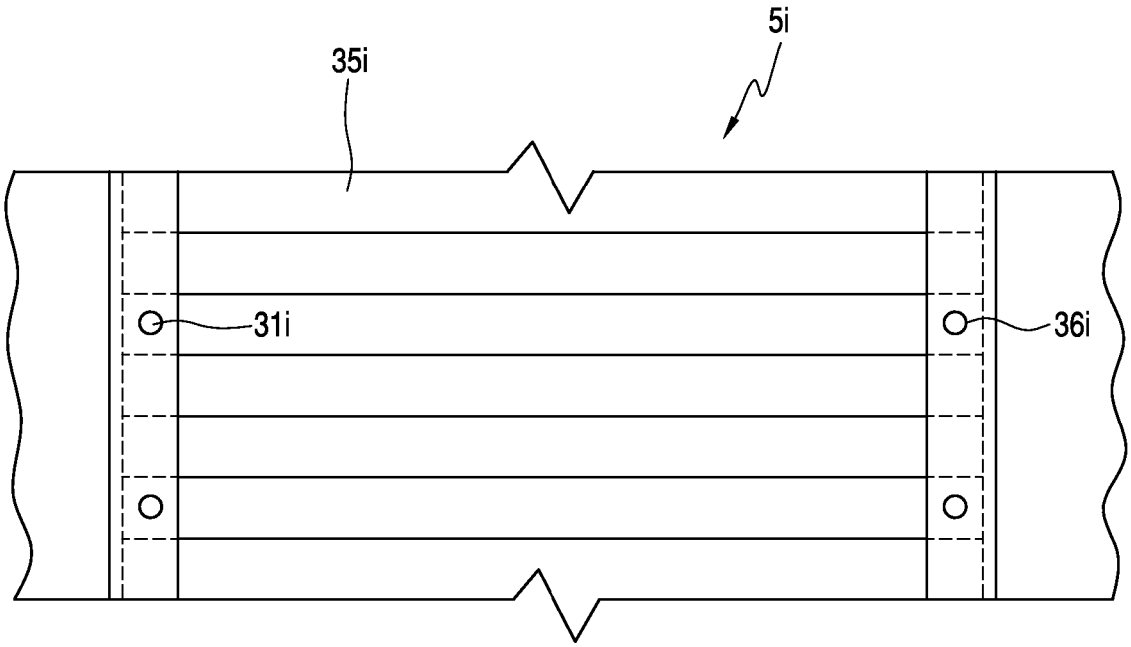
FIG. 24 is a plan view of the ninth exemplary embodiment shown in FIG. 21, viewed from a bottom of the exemplary structure.

Structural assembly 15*i* may also include a plurality of alignment elements 31*i* that may be removably attachable to intermediate structural members 30*i* and member 35*i*. As illustrated in FIGS. 21 and 24, intermediate structural member 30*i* may have a plurality of apertures 32*i* and member 35*i* may have a plurality of apertures 36*i*. Member 35*i* may be placed on intermediate structural members 30*i* so that apertures 32*i* and 36*i* are aligned. Alignment elements 31*i* may be inserted through respective apertures 32*i* and 36*i* and removably attached, thereby fastening member 35*i* to intermediate structural members 30*i*. As illustrated in FIG. 21, member 35*i* may have flat end portions, relative to a depth of member 35*i* at a center portion. It is also contemplated that alignment elements 31*i* may be permanently attached to intermediate structural members 30*i* or member 35*i*.

Figure 22:
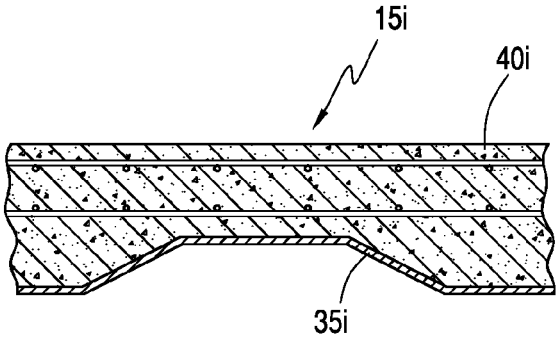
FIG. 22 is a sectional view taken through section G-G of the ninth exemplary embodiment shown in FIG. 21.
Figure 23:
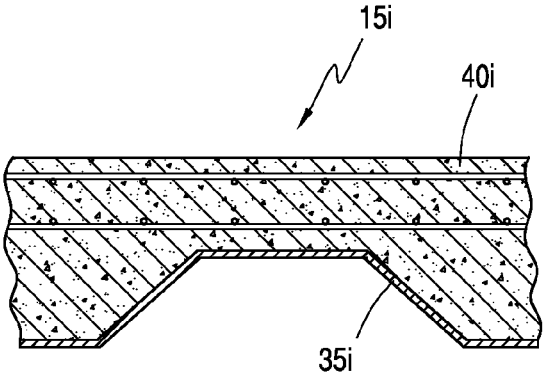
FIG. 23 is a sectional view taken through section H-H of the ninth exemplary embodiment shown in FIG. 21.

As illustrated in FIGS. 21, 22, and 23, a depth of member 35*i* may be varied, and accordingly, a depth of structural layer 25*i* is varied due to the variation of the depth of corrugations of member 35*i*. A depth dimension of at least a part of member 35*i* may be variable in at least one direction (e.g., the depth may vary in a direction that is transverse to a longitudinal direction of structural members 10*i*, as illustrated in FIGS. 21-23). It is also contemplated that the depth dimension of at least a part of member 35*i* may vary in a direction that is parallel to a longitudinal direction of structural members 10*i*. The depth of structural layer 25*i* may therefore be reduced at locations of relatively small moment and/or shear forces on structure 5*i*, and the depth of structural layer 25*i* may be increased at locations of relatively larger moment and/or shear forces. Therefore, structural layer 25*i* may have a larger moment of inertia at locations where maximum moment forces develop in structure 5*i*. Also, as illustrated in FIGS. 21 and 24, structural material 40*i* of structural layer 25*i* may be retained without the use of end caps when structural material 40*i* is in a plastic state because flattened end portions of member 35*i* may bear in a flush manner on intermediate structural member 30*i*. Therefore, structural material 40*i* in a plastic state such as uncured concrete may be supported without structural material 40*i* leaking between intermediate structural member 30*i* and member 35*i*.

Wherever appropriate, features of any of the above disclosed exemplary embodiments may be utilized with any other of the above disclosed exemplary embodiments.

INDUSTRIAL APPLICABILITY

The exemplary disclosed structure and method may be used in any application involving construction using a structural material that hardens from a plastic state into a hardened state. For example, the disclosed structure and method may be used in applications involving a stay-in-place form that supports concrete in a plastic state that cures into hardened concrete. The exemplary disclosed structure and method may be used in any suitable commercial, residential, or industrial application such as, for example, a bridge superstructure assembly, a building floor or roof structural assembly, substructure elements, or a coastal civil engineering structure. For example, the exemplary disclosed structure and method may be used with a concrete deck for a bridge that is supported by longitudinal or transverse structural members.

Figure 25:
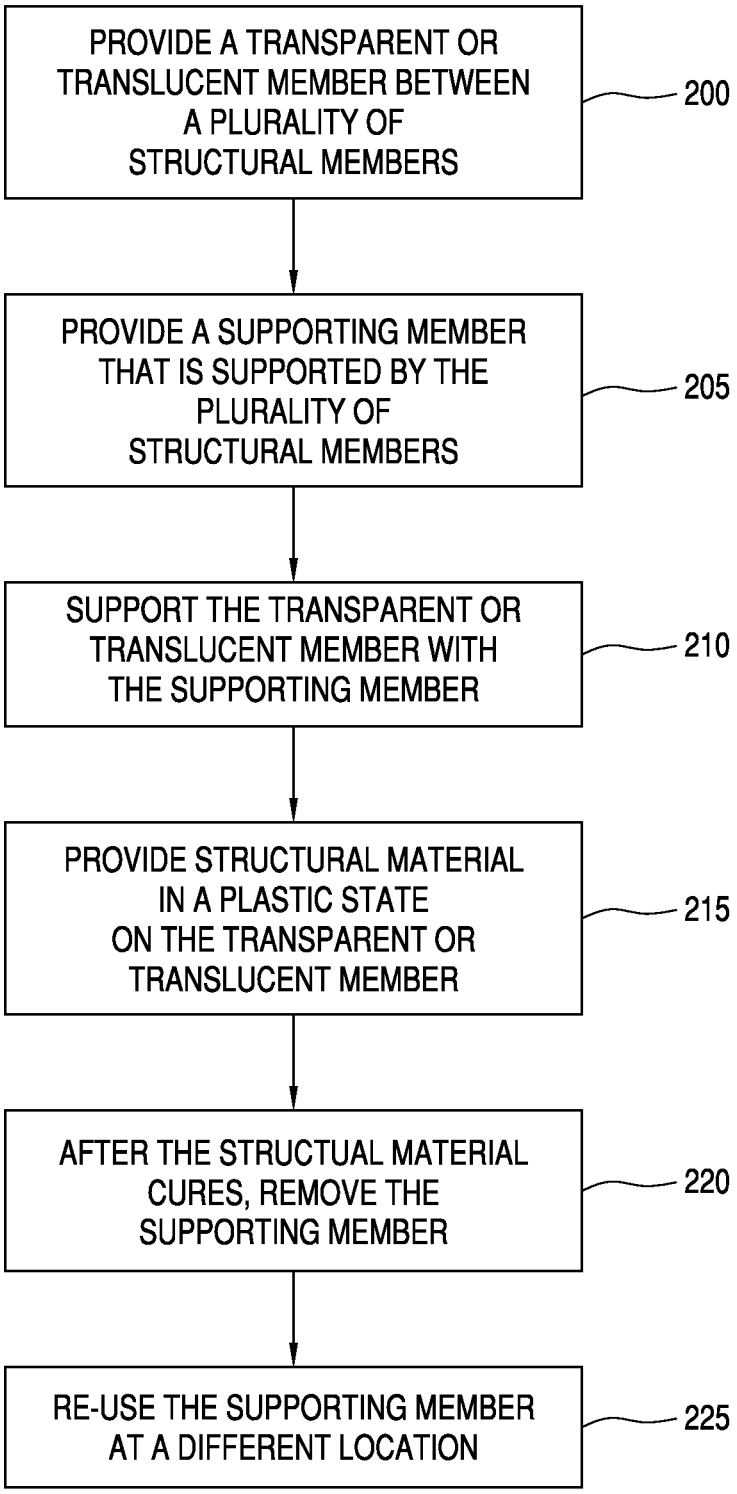
FIG. 25 is a flow chart for an exemplary disclosed construction method.

FIG. 25 illustrates an exemplary disclosed construction method. Structure 5*e*, illustrated in FIGS. 9-12, will be used as an exemplary embodiment to illustrate the exemplary disclosed construction method, though any of the disclosed embodiments may also be used to illustrate the exemplary disclosed construction method.

In step 200, member 35*e* is provided as a translucent or transparent member between a plurality of structural members 10*e*. Member 35*e* is supported by bearing contact with an upper surface of intermediate structural members 30*e* attached to respective structural members 10*e*. Member 35*e* may thereby be provided as a bottom support between the plurality of structural members 10*e*. Also, as illustrated in FIG. 5, a plurality of additional transparent or translucent members may be stacked on member 35*e* (similar to members 65*b* stacked on member 35*b*, as illustrated in FIG. 5) to provide additional support for structural material in a plastic state that is to be supported.

Also, as an alternative embodiment illustrating step 200, the member may be provided as illustrated in FIGS. 21-24. In this alternative embodiment, member 35*i* is provided on intermediate structural members 30*i* via alignment elements 31*i* that are disposed in apertures 32*i* and 36*i*.

In step 205, returning to FIG. 25 (and to structure 5*e* illustrated in FIGS. 9-12), supporting member 75*e* is provided as a supporting member. Supporting member 75*e* is supported by intermediate structural members 30*e* attached to respective structural members 10*e* via connection 80*e*.

In step 210, supporting member 75*e* is used to support transparent or translucent member 35*e*. Supporting member 75*e* supports member 35*e* by bearing contact between the lower surface of member 35*e* and the upper surface of supporting member 75*e*.

In step 215, structural material 40*e* is provided in a plastic state on transparent or translucent member 35*e*. Member 35*e* may thereby be used as a bottom support to support structural material 40*e* in a plastic state. Supporting member 75*e* stiffens member 35*e*, thereby providing reinforcement to member 35*e* in supporting structural material 40*e* in a plastic state. Structural material 40*e* begins to harden while supported by member 35*e* that is reinforced by supporting member 75*e*. Member 35*e* may thereby be used as a bottom support to support structural material 40*e* as it hardens from a plastic state into a hardened state. Because structural layer 25*e* is visible through transparent or translucent member 35*e*, structural material 40*e* in a plastic state is visible. Thus, for example, a construction inspector may inspect structural material 40*e* in a plastic state for deficiencies such as, for example, voids left during concrete placement. An inspector, therefore, could direct structural material 40*e* in a plastic state to be improved, for example, by additional vibrating and/or adding additional structural material 40*e* in a plastic state to ensure that structural layer 25*e* is adequately placed.

In step 220, structural material 40*e* hardens (e.g., cures) from a plastic state into a hardened state, and structural layer

25*e* is capable of supporting load on its own. Supporting member 75*e* is removed. Member 35*e* remains attached to structural layer 25*e*, and structural layer 25*e* supports load. Structural material 40*e* may thereby remain in contact with member 35*e*, which may serve as a bottom support, after structural material 40*e* hardens. In the exemplary case that a plurality of transparent or translucent members is stacked to provide additional support for structural material in a plastic state, as disclosed above in step 200, the additional members are removed. Alternatively, as disclosed above, supporting member 75*e* may be permanently attached to member 35*e* and may continue to reinforce structural assembly 15*e*.

Thus, when structural assembly 15*e* is viewed, for example, from below during a structural inspection, structural layer 25*e* is visible through transparent or translucent member 35*e*. A structural evaluation of structural layer 25*e* may therefore be easily made because structural layer 25*e* remains visible to the structural evaluator.

In step 225, supporting member 75*e* is re-used at a different location. Supporting member 75*e* may thereby be re-used in step 205 at a different location.

As illustrated in FIGS. 17-19 and 25, an exemplary method of construction for structure 5*g* may be similar to the method disclosed above. In step 200, member 35*g* is provided as a translucent or transparent member between a plurality of structural members 10*g*. In step 205, supporting assembly 75*g* is provided as a supporting member. Member 80*g*, having members 85*g* attached to member 80*g* as disclosed above, is nested in one or more cavities of member 35*g*. Member 80*g* is supported by intermediate structural members 30*g* attached to respective structural members 10*g* in a manner similar to the attachment of intermediate structural members 30*e* to respective structural members 10*e* via connection 80*e*, disclosed above. Supporting member 90*g* is disposed in recesses 87*g* of members 85*g*.

In step 210, supporting assembly 75*g* is used to support transparent or translucent member 35*g*. Member 80*g* supports member 35*g* by bearing contact between the lower surface of member 35*g* and the upper surface of member 80*g*. Surfaces of member 85*g* may be in bearing contact with a lower surface of member 80*g*, thereby stiffening member 80*g*. Supporting member 90*g* may be in bearing contact with a surface of each member 85*g* at each recess 87*g*, thereby increasing the overall stiffness of supporting assembly 75*g* in supporting member 35*g*.

Similar to the method disclosed above, in step 215, structural material 40*g* is provided in a plastic state on transparent or translucent member 35*g*. Structural material 40*g* hardens (e.g., cures) while supported by member 35*g* that is reinforced by supporting assembly 75*g*. In step 220, structural material 40*g* hardens (e.g., cures) from a plastic state into a hardened state, and thus structural layer 25*g* is capable of supporting load on its own. Members 80*g* and 85*g* and supporting member 90*g* of supporting assembly 75*g* are removed. Alternatively, supporting member 90*g* is removed and members 80*g* and 85*g* remain permanently attached to member 35*g*. Member 35*g* remains attached to structural layer 25*g*, and structural layer 25*g* supports load. In step 225, supporting assembly 75*g* is re-used at a different location. Alternatively, supporting member 90*g* is re-used at a different location and members 80*g* and 85*g* remain permanently attached to member 35*g*.

As illustrated in FIGS. 20 and 25, an exemplary method of construction for structure 5*h* may be similar to the method for structure 5*e* disclosed above. In step 200, member 35*h* is provided as a translucent or transparent member between a plurality of structural members 10*h*.

In step 205, supporting assembly 75*h* is provided as a supporting member, similar to the manner in which supporting assembly 75*g* is provided, disclosed above. Supporting member 95*h* and/or supporting member 100*h* is displaced relative to coupler 105*h* so that an overall length of supporting member assembly 90*h* is less than a clear distance between intermediate structural members 30*h*. For example, supporting member 95*h* and/or supporting member 100*h* are rotated so that threaded surfaces of supporting member 95*h* and/or supporting member 100*h* displace relative to threaded surfaces of coupler 105*h*. For example, displacing supporting member 95*h* and/or supporting member 100*h* into coupler 105*h* includes doweling respective threaded attachment portions 110*h* and 115*h* into a threaded attachment aperture of coupler 105*h*. Also, for example, coupler 105*h* is released in any manner disclosed above to allow supporting member 95*h* and/or supporting member 100*h* to be displaced. Respective end portions 125*h* and 130*h* are then placed above respective end portions of intermediate structural members 30*h*. Supporting member assembly 90*h* is thereby disposed in recesses 87*h* of members 85*h*. Supporting member 95*h* and/or supporting member 100*h* is then displaced relative to coupler 105*h* so that an overall length of supporting member assembly 90*h* is greater than a clear distance between intermediate structural members 30*h*, as illustrated in FIG. 20. Respective end portions 125*h* and 130*h* bear on intermediate structural members 30*h*, to thereby support supporting member assembly 90*h* on intermediate structural members 30*h*.

In step 210, supporting assembly 75*h* is used to support transparent or translucent member 35*h*, in a manner similar to supporting assembly 75*g* supporting member 35*g*, disclosed above. In step 215, structural material 40*h* is provided in a manner similar to providing structural material 40*g*, disclosed above. In step 220, structural material 40*h* hardens (e.g., cures) from a plastic state into a hardened state, and thus structural layer 25*h* is capable of supporting load on its own. Supporting member assembly 90*h* is removed by displacing supporting member 95*h* and/or supporting member 100*h* relative to coupler 105*h* in a manner similar to the displacement disclosed above. Supporting assembly 75*h* is removed. Alternatively, supporting member assembly 90*h* is removed and members 80*h* and 85*h* remain permanently attached to member 35*h*. Member 35*h* remains attached to structural layer 25*h*, and structural layer 25*h* supports load. In step 225, supporting assembly 75*h* is re-used at a different location. Alternatively, supporting member assembly 90*h* is re-used at a different location and members 80*h* and 85*h* remain permanently attached to member 35*h*.

The exemplary disclosed structure and method may provide a system for inspecting structural material over a life of the structure, for example, during construction and during a service life of the structure. For example, an inspector may view a majority of structural material 40 in a plastic state through transparent or translucent member 35 during construction, and may view a majority of hardened structural material 40 through transparent or translucent member 35 during construction. Also, the exemplary disclosed structure includes relatively few components and may provide a simple and efficient method for construction that allows visible inspection of a structure. The exemplary disclosed structure and method may thereby reduce labor costs and construction time, while allowing maintenance inspections of a structure for corrosion, cracking, spalling, and other degradations.

It will be apparent to those skilled in the art that various modifications and variations can be made to the disclosed structure and method. Other embodiments will be apparent to those skilled in the art from consideration of the specification and practice of the disclosed method and apparatus. It is intended that the specification and examples be considered as exemplary only, with a true scope being indicated by the following claims and their equivalents.

What is claimed is:

1. A construction method, comprising:

providing a bottom support between a plurality of structural members;

using the bottom support to support a structural material in a plastic state; and using the bottom support to support the structural material as the structural material hardens from a plastic state into a hardened state;

wherein the structural material remains in contact with the bottom support after the structural material hardens, the structural material and the bottom support forming a structural assembly;

wherein the bottom support is transparent or translucent;

wherein the plurality of structural members transfers load from the structural assembly to additional structural elements;

wherein the structural material in the plastic state is concrete in a plastic state;

wherein the structural material in the hardened state is structural reinforced concrete; and wherein the plurality of structural members are bridge superstructure structural members.

2. A construction method, comprising:

providing a form member between a plurality of structural members;

providing a supporting member between the plurality of structural members, the supporting member being supported by the structural members;

supporting the form member with the supporting member; and providing a structural material in a plastic state on the form member;

wherein the form member is transparent or translucent;

wherein a lower surface of the form member is in bearing contact with an upper surface of the supporting member;

wherein the structural material in the plastic state is concrete in a plastic state; and removing the supporting member after the structural material hardens, and re-using the supporting member to support another form member at another location.

3. The construction method of claim 2, wherein the supporting member is a removable form that is transparent or translucent.

4. The construction method of claim 3, further including providing additional removable forms that are stacked beneath the form member and the supporting member that is a removable form.

5. The construction method of claim 2, wherein the form member is a corrugated form, and the supporting member is a removable corrugated metal form that is nested with the form member.

6. The construction method of claim 2, wherein:

the form member is one of a substantially flat member or a corrugated member; and the form member is transparent plastic.

7. The construction method of claim 2, wherein:

a lower surface of the form member is in bearing contact with an upper surface of the supporting member;

the supporting member is one of a reinforcing bar, a prefabricated structural shape, and a plate; and the supporting member is made from one or more of steel, wood, and composite material.

8. A construction method, comprising:

providing a stay-in-place form between a plurality of structural members;

providing a supporting member between the plurality of structural members, the supporting member being supported by the plurality of structural members;

supporting the stay-in-place form with the supporting member, wherein the stay-in-place form is in contact with the supporting member;

providing uncured concrete in a plastic state on the stay-in-place form; and removing the supporting member after the concrete cures;

wherein the stay-in-place form is transparent or translucent; and wherein the plurality of structural members transfers load from the supporting member to additional structural elements or directly to the ground;

wherein providing the supporting member includes providing a supporting member including two elements and a coupler coupling the two elements; and wherein removing the supporting member includes displacing a first end of at least one of the two elements of the supporting member into the coupler so that a second end of the at least one of the two elements displaces away from the structural member supporting the at least one element.

9. The construction method of claim 8, wherein:

displacing the at least one of the two elements of the supporting member into the coupler includes doweling a threaded end portion of the at least one of the two elements of the supporting member into a threaded aperture of the coupler.

10. The construction method of claim 8, further including re-using the supporting member to support another stay-in-place form at another location.

11. The construction method of claim 8, wherein removing the supporting member includes saw-cutting the supporting member.

12. The construction method of claim 8, wherein providing the stay-in-place form between the plurality of structural members includes attaching the stay-in-place form to a plurality of intermediate structural members, at least one of the plurality of intermediate structural members being attached to each structural member.

13. The construction method of claim 12, wherein attaching the stay-in-place form to the plurality of intermediate structural members includes epoxying the stay-in-place form to the plurality of intermediate structural members.

14. The construction method of claim 12, wherein attaching the stay-in-place form to the plurality of intermediate structural members includes fastening an end portion of the stay-in-place form to at least one of the intermediate structural members via an alignment pin.

* * * * *